United States Patent [19]

Pasiecznik

[11] Patent Number: 4,495,741

[45] Date of Patent: Jan. 29, 1985

[54] ADJUSTABLE SPACER KIT OF PARTS, AND BUILDING WALL OR ROOF STRUCTURE INCORPORATING THE SAME

[75] Inventor: Eugene Pasiecznik, Hamilton, Canada

[73] Assignee: Westeel-Rosco Limited-Westeel-Rosco Limitee, Toronto, Canada

[21] Appl. No.: 401,940

[22] Filed: Jul. 26, 1982

[51] Int. Cl.[3] ..... E04B 1/74

[52] U.S. Cl. ..... 52/404; 52/410; 52/487; 52/508

[58] Field of Search ..... 52/404, 407, 408, 410, 52/508, 544, 487

[56] References Cited

U.S. PATENT DOCUMENTS

| | | | |
|---|---|---|---|
| 2,064,984 | 12/1936 | Marsh . | |
| 2,618,961 | 11/1952 | Williamson . | |
| 2,796,158 | 6/1957 | Miles et al. . | |
| 2,893,068 | 7/1959 | Johnson | 52/404 |
| 3,218,771 | 11/1965 | Horn | 52/404 |
| 3,229,441 | 1/1966 | Heffner | 52/404 |
| 3,333,379 | 8/1967 | Harris . | |
| 3,427,775 | 2/1969 | Bachrich | 52/404 |
| 3,521,419 | 7/1970 | Fornells . | |
| 3,525,189 | 8/1970 | Nelsson . | |
| 3,572,000 | 3/1971 | Gustavsson . | |
| 3,889,439 | 6/1975 | Kaspar . | |
| 3,956,998 | 5/1976 | Baretz | 52/481 |
| 4,060,951 | 12/1977 | Gere . | |
| 4,170,858 | 10/1979 | Walker . | |
| 4,232,845 | 11/1980 | Turner . | |
| 4,257,204 | 3/1981 | Rieger | 52/404 |

FOREIGN PATENT DOCUMENTS

| | | | |
|---|---|---|---|
| 1417178 | 12/1972 | United Kingdom | 52/508 |

*Primary Examiner*—Henry E. Raduazo

*Attorney, Agent, or Firm*—Ridout & Maybee

[57] ABSTRACT

There is disclosed a building wall or roof structure comprising support beams, an inner liner mounted on the support beams, outer cladding, a plurality of spacers spacing the outer cladding from the inner liner, and thermal insulation disposed between the inner liner and the outer cladding. In order that for different buildings the thickness of the thermal insulation may vary each spacer is adjustable and comprises a plurality of spaced brackets each of which has a first end portion mounted on the inner liner and an opposed second end portion and each of which presents a projecting tab spaced from the first end portion. Each spacer also comprises a member or members each of which has at least one row of holes provided therein and each of which has a first edge portion presenting a projecting first flange and a second edge portion presenting a projecting second flange which projects in a direction opposite to the first flange and to which the outer cladding is secured. The member or members of each adjustable spacer are mounted on the brackets of the adjustable spacer in one of a plurality of positions which comprise a first position in which the tab of each bracket projects through one of the holes in the member or one of the members whereby the spacing between the outer cladding and the inner liner is of a first pre-determined magnitude, and a second position in which the first flange of the member or one of the members is in abutting contact with the tab of each bracket whereby the spacing between the outer cladding and the inner liner is of a second pre-determined magnitude greater than said first pre-determined magnitude.

10 Claims, 4 Drawing Figures

Figure 1:
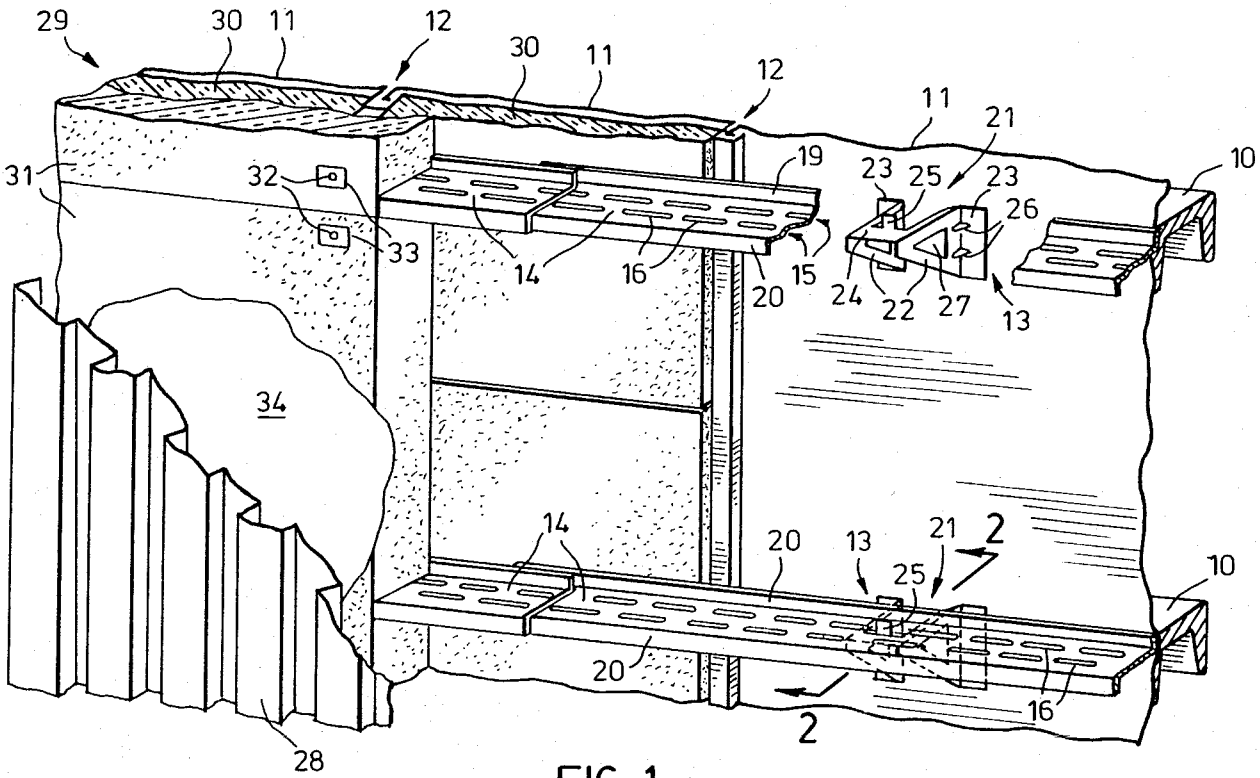

ADJUSTABLE SPACER KIT OF PARTS, AND BUILDING WALL OR ROOF STRUCTURE INCORPORATING THE SAME

This invention is concerned with an adjustable spacer kit of parts which are adapted to be assembled together to provide an adjustable spacer assembly particularly, although not exclusively, for use in a building wall or roof structure.

It has hitherto been known to provide a building wall or roof structure which comprises an inner liner mounted on support means which may be constituted by spaced, parallel metal support beams, outer cladding being mounted outwardly of the inner liner by means of spacers with the space between the inner liner and the outer cladding and which may typically be of the order of about 1.5 inches in thickness being occupied by a layer or layers of insulation material such as insulation material of the glass fiber type.

With rapidly escalating costs of oil and other forms of heating energy it has become economically advisable in order to minimize energy costs for the heating of a building substantially to increase the thickness of the above-mentioned layer or layers of insulation between the inner liner and the outer cladding, and nowadays such a layer or layers of insulation having a thickness of the order of 6 inches or more are frequently recommended. However, depending on the nature and intended use of a building and of course on its geographic location the optimum thickness of the layer or layers of insulation and hence of the above-described spacers between the inner liner and the outer cladding may vary substantially for different buildings, and it is a primary object of the present invention to provide an adjustable spacer kit of parts which are adapted to be assembled into an adjustable spacer a plurality of which may be used as the above-described spacers between the inner liner and outer cladding of a building wall or roof structure, the spacer kit of parts being adapted to be so assembled as to provide a spacer having any selected one of a plurality of thicknesses, thereby avoiding the increased costs of manufacturing and stocking a range of spacers of the different thicknesses.

In accordance with one aspect of the present invention there is provided an adjustable spacer kit of parts comprising a member having a first edge portion and an opposed second edge portion and having at least one hole provided therein, and a bracket having a first end portion and an opposed second end portion and presenting a projecting tab spaced from the first end portion of said bracket. Said member is adapted to be mounted on said bracket in one of a plurality of alternative positions which comprise a first position in which the tab projects through the hole in said member whereby the spacing between the first end portion of said bracket and the second edge portion of said member is of a first predetermined magnitude, and a second position in which the first edge portion of said member is in abutting contact with the tab of said bracket whereby the spacing between the first end portion of said bracket and the second edge portion of said member is of a second predetermined magnitude greater than said first pre-determined magnitude. The bracket comprises two spaced, parallel side plates, and a web interconnecting the side plates only at the second end portion of the bracket, with the tab being presented by the web of the bracket.

In accordance with a further aspect of the invention there is provided a building wall or roof structure comprising support means, an inner liner mounted on the support means, outer cladding, a plurality of adjustable spacers spacing the outer cladding from the inner liner, and thermal insulation disposed between the inner liner and the outer cladding. Outer cladding, with an air barrier between the thermal insulation and the outer cladding. Each adjustable spacer comprises a plurality of spaced brackets each of which has a first end portion mounted on the inner liner and an opposed second end portion and each of which presents a projecting tab spaced from the first end portion, and a member or members each of which has at least one row of hole provided therein and each of which has a first edge portion presenting a projecting first flange and a second edge portion presenting a projecting second flange which projects in a direction opposite to the first flange and to which the outer cladding is secured. Said member or members of each adjustable spacer are mounted on said brackets of the adjustable spacer in one of a plurality of positions which comprise a first position in which the tab of each said bracket projects through one of the holes in said member or one of said members whereby the spacing between the outer cladding and the inner liner is of a first pre-determined magnitude, and a second position in which the first flange of said member or one of said members is in abutting contact with the tab of each said bracket whereby the spacing between the outer cladding and the inner liner is of a second pre-determined magnitude greater than said first pre-determined magnitude.

Figure 2:
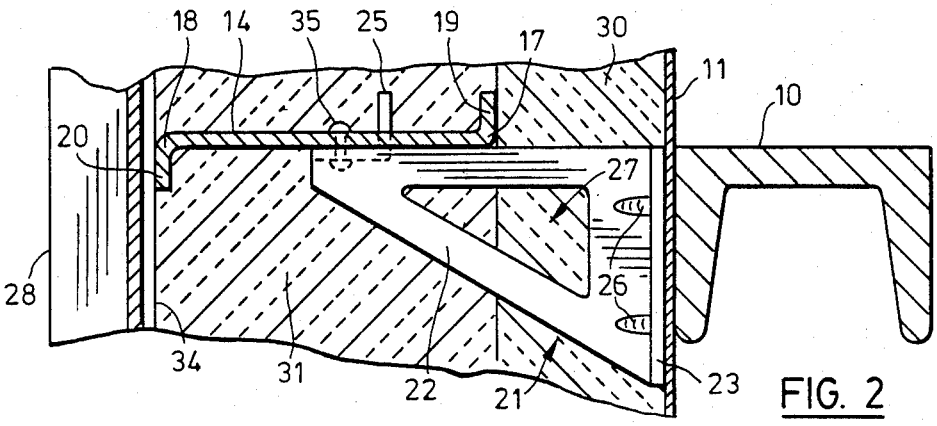
Figure 3:
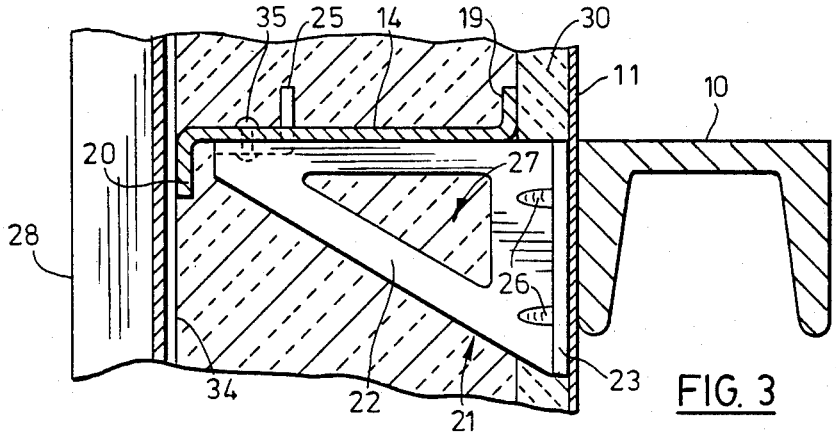
Figure 4:
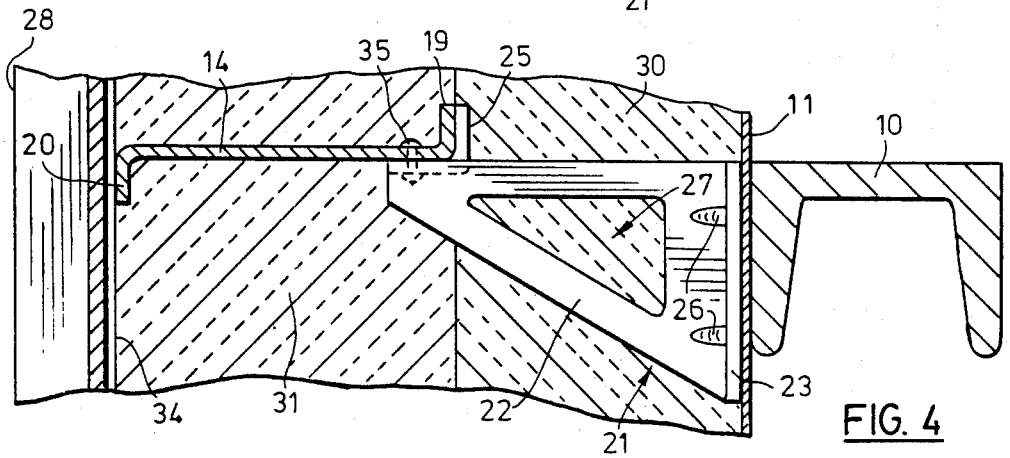

In order that the invention may be more clearly understood and more readily carried into effect the same will now, by way of example, be more fully described with reference to the accompanying drawings in which FIG. 1 is a view, partly brokenaway for clarity, of a portion of a building wall structure according to a preferred embodiment of said further aspect of the present invention;

FIG. 2 is a sectioned view on the line 2—2 in FIG. 1, and showing on an enlarged scale an adjustable spacer formed from an adjustable spacer kit of parts according to a preferred embodiment of said one aspect of the invention; and FIGS. 3 and 4 are views corresponding to FIG. 2 but showing the spacer in alternative conditions.

Referring to the drawings, and with particular reference to FIG. 1, 10 denotes each of a plurality of spaced, parallel metal support beams which, as shown in FIG. 1, may be of inverted U-shape in transverse cross-section. These beams 10 which constitute part of the structural framework of the building in question together constitute support means on which is mounted an inner liner constituted by a plurality of inner liner sheets 11 of sheet metal form. The vertical edge portions of each of these sheets 11 are formed of generally J-shape in transverse cross-section with one of these edge portions constituting a male member and the other of these edge portions constituting a female member so that the adjacent edge portions of adjacent sheets 11 may be securely interlocked as indicated by the reference numeral 12 in FIG. 1.

Mounted on the outer faces of the sheets 11 are adjustable spacers denoted generally by the reference numeral 13. Each spacer 13 comprises one or more members 14 having two rows 15 of a plurality of holes 16 which are of slotted configuration. Each member 14 has a first edge portion 17 and an opposed second edge portion 18, the first edge portion 17 preferably presenting a projecting first flange 19 and the second edge portion 18 preferably presenting a projecting second flange 20 which is oppositely directed to the first flange 19, so that the member 14 together with the flanges 19 and 20 presented thereby is of generally Z-shaped form in transverse cross-section thereby to improve the strength and rigidity of the member 14.

The spacer 13 also comprises a plurality of spaced brackets 21 on which the member or members 14 of the spacer 13 are mounted and each of which preferably incorporates two spaced, parallel side plates 22 of generally triangular shape and the end of which at a first end portion of the bracket 21 presents an outwardly directed mounting flange 23 by means of which the bracket 21 may be bolted, rivetted or otherwise secured through the appropriate inner liner sheet 11 to the appropriate beam 10. A web 24 interconnects the side plates 22 only at a second end portion of the bracket 21 opposed to the first end portion thereof, and a projecting tab 25 is presented by the web 24, this tab 25 being spaced from the first end portion of the bracket 21 i.e. from the end portion thereof at which the mounting flanges 23 are disposed. Reinforcement fillets 26 may be provided between each mounting flange 23 and the associated side plate 22.

As will be appreciated, each bracket 21 and each member 14 together with the associated flanges 19 and 20 may conveniently and simply be formed of sheet metal construction, and since the web 24 interconnects the side plates 22 only at the second end portion of the bracket 21 and openings 27 are provided in these side plates 22 the cross-sectional area of the heat flow paths from the inner liner sheets 11 through the brackets 21 is minimized with the result that such heat flow through the brackets 21 from the inner liner sheets 11 is substantially reduced. Likewise, since as clearly shown in FIG. 1 the holes 16 of each row 15 thereof are staggered relative to the holes 16 of the other row 15 thereof the length of the heat flow paths across each member 14 is increased and the cross-sectional area of these heat flow paths is minimized as a result of the holes 16 thereby reducing heat flow across the member 14, reference in this connection being made to U.S. Pat. No. 3,525,189 issued on Aug. 25, 1970 to N. Nelsson in which a member similar in shape and configuration to the member 14 together with the associated flanges 19 and 20 is disclosed. Furthermore, the spacing between the holes 16 of each row 15 thereof is of course arranged to be compatible with the spacing requirements between the brackets 21 of each spacer 13, and the dimensions of each hole 16 are preferably substantially greater than the cross-sectional dimensions of the tab 25 of each bracket 21 thereby to facilitate the assembly of the member or members 14 and the brackets 21 of each spacer 13 and to provide tolerances for the locations of the brackets 21.

Outer cladding constituted by interconnected outer cladding sheets 28 which may, as shown in FIG. 1, be of vertically corrugated form is secured by, for example, bolts, rivets, sheet metal screws or the like to the flange 20 presented by each member 14, and thermal insulation which may be of glass fiber and which is denoted generally by the reference numeral 29 is disposed between the inner liner sheets 11 and the outer cladding sheets 28. This thermal insulation 29 preferably comprises a first layer of thermal insulation batts 30 which are mounted between the inner liner sheets 11 and the members 14 of the spacers 13, and a second layer of thermal insulation batts 31 which are mounted between the first layer of insulation batts 30 and the outer cladding sheets 28 and between the spacers 13, the insulation batts 30 and 31 being secured to the inner liner sheets 11 by, for example, rivets 32 or the like disposed through plates 33 on the outer faces of the insulation batts 31. The outer face of each insulation batt 31 may be constituted by a sheet of paper or paper-like material the lower edge portion of which extends downwardly to overlap the flange 20 of each member 14. For clarity the brackets 21 are shown in FIG. 1 on an enlarged scale, but in practice these brackets 21 are preferably sufficiently small that they may readily be pushed through the insulation batts 30. An air barrier 34 may, if required, be disposed between the outer cladding sheets 28 and the second layer of insulation batts 31, the installation of this air barrier 34 being facilitated since the outer face of the second layer of insulation batts 31 is substantialy flush thereby avoiding the formation of air pockets between the air barrier 34 and the outer face of the second layer of insulation batts 31.

With particular reference to FIG. 2, it will be noted that the projecting tab 25 of each bracket 21 is disposed through an appropriate one of the holes 16 in the row 15 thereof closest to the flange 19, and the thickness of the spacer 13 constituted by the spacing between the second edge portion of the or each member 14 at the flange 20 and the first end portion of the bracket 21 at the flanges 23 is of a first pre-determined first magnitude. In the alternative assembly of the spacer 13 shown in FIG. 3 the projecting tab 25 of each bracket 21 is instead disposed through an appropriate one of the holes 16 in the row 15 thereof furthest from the flange 19 so that the above-mentioned thickness of the spacer 13 between the flange 20 and the flanges 23 of the bracket 21 is of a reduced second pre-determined magnitude. As shown in FIG. 4 the member 14 is mounted on each bracket 21 with the flange 19 in abutting contact with the projecting tab 25 of the bracket 21 instead of the projecting tab 25 being disposed through one of the holes 16, so that the above-mentioned thickness of the spacer 13 between the flange 20 and the flanges 23 is of an increased third pre-determined magnitude. In each of FIGS. 2, 3 and 4 the member 14 is secured to the bracket 21 by, for example, a rivet or rivets 35, spot welding, sheet metal screws or the like.

While the present invention is herein described with reference to the accompanying drawings in relation to a building wall strucuture it will be appreciated that the invention is equally applicable to a building roof structure.

Thus, the present invention provides an adjustable spacer kit of parts comprising one of the members 14 and one of the brackets 21 wherein the said member 14 and bracket 21 may be assembled to provide a spacer 13 having a plurality of thicknesses between the second edge portion of the member 14 and the first end portion of the bracket 21. While in the preferred embodiment of the invention hereinbefore described with reference to the accompanying drawings there are two rows 15 of the holes 16 it will be appreciated that in alternative embodiments (not shown) there may be only one row 15 of the holes 16 or more than two rows 15 of the holes 16. Furthermore, the row or rows 15 of the holes 16 in each member 14 could, of course, each comprise only a sngle hole 16.

The embodiments of the invention in which an exclusive property or privilege is claimed are defined as follows:

1. An adjustable spacer kit of parts comprising a member having a first edge portion and an opposed second edge portion and having at least one hole provided therein, and a bracket having a first end portion and an opposed second end portion and presenting a projecting tab spaced from the first end portion of said bracket, the first edge portion of said member presenting a projecting flange, said member being adapted to be mounted on said bracket in one of a plurality of alternative positions which compise a first position in which the tab projects through the hole in said member whereby the spacing between the first end portion of said bracket and the second edge portion of said member is of a first predetermined magnitude, and a second position in which the flange of said member is in abutting contact with the tab of said bracket whereby the spacing between the first end portion of said bracket and the second edge portion of said member is of a second pre-determined magnitude greater than said first pre-determined magnitude, and said bracket comprising two spaced, parallel side plates, and a web interconnecting the side plates only at the second end portion of said bracket, with the tab being presented by the web of said bracket.

2. An adjustable spacer kit of parts according to claim 1, wherein said at least one hole in said member comprises a plurality of holes disposed in a plurality of spaced, substantially parallel rows which are spaced at different distances from the first edge portion of said member.

3. An adjustable spacer kit of parts according to claim 2, wherein the holes of each of the plurality of rows thereof are staggered relative to the holes of the adjacent row or rows thereof.

4. An adjustable spacer kit of parts according to claim 1, wherein a further projecting flange is presented by the second edge portion of said member, the flanges projecting from said member in opposite directions.

5. An adjustable spacer kit of parts according to claim 1, wherein said member is securable to said bracket when said member is mounted on said bracket in one of said first and second positions.

6. A building wall or roof structure comprising support means, an inner liner mounted on the support means, outer cladding, a plurality of adjustable spacers spacing the outer cladding from the inner liner, and thermal insulation disposed between the inner liner and the outer cladding, with an air barrier between the thermal insulation and the outer cladding, each adjustable spacer comprising a plurality of spaced brackets each of which has a first end portion mounted on the inner liner and an opposed second end portion and each of which presents a projecting tab spaced from the first end portion, and a member or members each of which has at least one row of holes provided therein and each of which has a first edge portion and a second edge portion to which the outer cladding is secured, with said member or members of each adjustable spacer being mounted on said brackets of the adjustable spacer in one of a plurality of positions which comprise a first position in which the tab of each said bracket projects through one of the holes in said member or one of said members whereby the spacing between the outer cladding and the inner liner is of a first pre-determined magnitude, and a second position in which the first edge portion of said member or one of said members is in abutting contact with the tab of each said bracket whereby the spacing between the outer cladding and the inner liner is of a second pre-determined magnitude greater than said first pre-determined magnitude.

7. A structure according to claim 6, wherein said insulation comprises a first layer of insulation between said member or members of each adjustable spacer and the inner liner, and a second layer of insulation between the first layer of insulation and the outer cladding, said second layer of insulation cmprising batts extending between said members of the adjustable spacers.

8. A structure according to claim 6, wherein the thermal insulation is of glass fiber.

9. A structure according to claim 6, wherein said bracket comprises two spaced, parallel side plates, and a web interconnecting the side plates only at the second end portion of said bracket, the tab being presented by the web of said bracket.

10. An adjustable spacer kit of parts comprising a member having a first edge portion and an opposed second edge portion and having at least one hole provided therein, and a bracket having a first end portion and an opposed second end portion and presenting a projecting tab spaced from the first end portion of said bracket, said member being adapted to be mounted on said bracket in one of a plurality of alternative positions which comprise a first position in which the tab projects through the hole in said member whereby the spacing between the first end portion of said bracket and the second edge portion of said member is of a first predetermined magnitude, and a second position in which the first edge portion of said member is in abutting contact with the tab of said bracket whereby the spacing between the first end portion of said bracket and the second edge portion of said member is of a second predetermined magnitude, greater than said first pre-determined magnitude, and said bracket comprising two spaced, parallel side plates, and a web interconnecting the side plates only at the second end portion of said bracket, with the tab being presented by the web of said bracket.

* * * * *